US012753689B2

(12) United States Patent
Innes et al.

(10) Patent No.: US 12,753,689 B2
(45) Date of Patent: Oct. 6, 2026

(54) METHOD AND SYSTEM FOR CONTROLLING DRILL FUNCTIONALITY

(71) Applicant: TECHNOLOGICAL RESOURCES PTY LIMITED, Melbourne (AU)

(72) Inventors: Chris Innes, Melbourne (AU); Joshua Leeman, Melbourne (AU); Ross Hennessy, Budgewoi (AU)

(73) Assignee: TECHNOLOGICAL RESOURCES PTY LIMITED, Melbourne (AU)

( * ) Notice: Subject to any disclaimer, the term of this patent is extended or adjusted under 35 U.S.C. 154(b) by 0 days.

(21) Appl. No.: 17/927,173

(22) PCT Filed: May 29, 2020

(86) PCT No.: PCT/AU2020/050555
§ 371 (c)(1),
(2) Date: Nov. 22, 2022

(87) PCT Pub. No.: WO2021/237268
PCT Pub. Date: Dec. 2, 2021

(65) Prior Publication Data

US 2023/0212935 A1 Jul. 6, 2023

(51) Int. Cl.
*E21B 44/02* (2006.01)
*E21B 4/06* (2006.01)
*E21B 44/00* (2006.01)

(52) U.S. Cl.
CPC ..... *E21B 44/02* (2013.01); *E21B 4/06* (2013.01); *E21B 44/00* (2013.01)

(58) Field of Classification Search
CPC ..... E21C 37/00; E21B 4/06
See application file for complete search history.

(56) References Cited

U.S. PATENT DOCUMENTS

| | | | | |
|---|---|---|---|---|
| 5,844,133 | A | 12/1998 | Goto et al. | |
| 7,350,593 | B1 * | 4/2008 | Brookover | E21B 44/02 173/4 |
| 2009/0071715 | A1 | 3/2009 | Sormunen et al. | |
| 2020/0149383 | A1 * | 5/2020 | Moberg | E21B 1/38 |
| 2020/0181981 | A1 * | 6/2020 | Miller | E21B 1/00 |

(Continued)

OTHER PUBLICATIONS

Jul. 22, 2020—(WO) International Search Report and Written Opinion—App. No. PCT/AU2020/050555—14 pages.

(Continued)

*Primary Examiner* — Tara Schimpf
*Assistant Examiner* — Ursula Lee Norris
(74) *Attorney, Agent, or Firm* — Banner & Witcoff, Ltd.

(57) ABSTRACT

Disclosed herein are a method and system for controlling a drill rig by utilising a drill control module. A drill control module for controlling functionality of a drill rig comprises: a processor; a storage medium for storing a computer program having instructions that when executed on the processor perform the method steps of: drilling a hole by repeatedly: activating a hammer drilling mode for a pre-defined interval parameter, said activated hammer drilling mode causing a drill bit of said drill rig to impact a surface using a hammer drilling technique; and activating a pause interval for a predefined interval time, during which said drill bit reduces engagement with said surface.

21 Claims, 8 Drawing Sheets

(56) References Cited

U.S. PATENT DOCUMENTS

2021/0180405 A1* 6/2021 Gunda ..... E21B 7/022

OTHER PUBLICATIONS

Apr. 28, 2022—(WO) IPRP for PCT/AU2020/050555—23 pages.
Feb. 6, 2024—(CL) Examiner's Report and Search Report—CL 202203311.
Ball, Peter, "Drilled Wells", 2001 vol. 6. ISBN:3-908001-98-6 https://skat.ch/wp-content/uploads/2017/01/Handbookvol. 6, 83 pages.

* cited by examiner

METHOD AND SYSTEM FOR CONTROLLING DRILL FUNCTIONALITY

CROSS-REFERENCE TO RELATED APPLICATIONS

This application is a U.S. National Stage application under 35 U.S.C. § 371 of International Application PCT/AU2020/050555 (published as WO 2021/237268 A1), filed on May 29, 2020. The prior application is hereby incorporated by reference in its entirety.

TECHNICAL FIELD

The present disclosure relates to a method and system for controlling drill functionality. In particular, the present disclosure relates to a method and system for controlling drill functionality in an autonomous drill rig.

BACKGROUND

Surface mines extract ore by blasting areas of rock. Each area that is to be blasted is called a bench. In order to blast a bench, which is generally level, a mining engineer, also referred to as a drill blast engineer, designs a blast for that bench. The designed blast takes into account many factors, including, but not limited to, access to the bench, the geology of the rock to be blasted, the drill rigs available for use, and type and quantity of explosives to be used. The mining engineer designs a drilling plan, also known as a drill pattern, which identifies the hole locations, hole sizes, and hole depths of the blast holes that are to be drilled by the drill rigs.

Once approved by the drill and blast engineer, the drilling plan is typically printed and handed to a team of drill operators assigned to an area of the bench to work on. It is common for two or three operator-controlled drill rigs to work contemporaneously on the same bench. The drill operators generally divide the bench area among themselves and then drill the holes in accordance with the drilling plan.

Once the drill rigs have drilled the holes, the holes are then filled with explosives by an explosives team and the explosives are detonated. The amount and type of explosive used for each blast is decided by the drill and blast engineer. The rubble produced by the blast is then collected by shovels and loaded into a fleet of dump trucks, which remove the rubble from the blast site to a processing plant. The rubble is a mixture of overburden and ore and the processing plant separates the ore from the overburden.

Drill rigs utilise a rotary function to drill blast holes on the bench of an open mine. During drilling, the cuttings produced by the rotating drill bit, such as a tricone rotary bit, are blown out of the hole by air from a compressor Evacuation of such cuttings is assisted by the rotation pressure of the drill bit, as well as by water that is pumped through the drill bit during drilling. It is desirable for the drill bit to be as straight as possible to produce the desired blast hole.

There is a need to provide an improved method and system for controlling drill rig functionality. There is also a need for providing improved drilling functionality to assist in evacuating cuttings while drilling holes.

SUMMARY

The present disclosure relates to a drill control method and system for controlling drill functionality in an autonomous drill rig.

A first aspect of the present disclosure provides a drill control module for controlling functionality of a drill rig, comprising:

- a processor; and
- a storage medium for storing a computer program having instructions that when executed on the processor perform the method steps of:
  - drilling a hole by repeatedly:
    - activating a hammer drilling mode for a predefined interval parameter, the activated hammer drilling mode causing a drill bit of the drill rig to impact a surface using a hammer drilling technique; and
    - activating a pause interval for a predefined interval time, during which the drill bit reduces engagement with the surface.

In some embodiments, the predefined interval parameter is one of an interval depth and an interval time. In some implementations, the predefined interval parameter is an interval depth in the range of 5 cm to 10 m.

In some embodiments, the drill rig retracts the drill bit to reduce engagement with the surface during the pause interval.

In some embodiments, the hammer mode is implemented using: a gain scheduling controller driven by an input air pressure value generated by the drill bit operating in the hammer mode, wherein the controller is utilised to generate a feed relief value for adjusting pressure applied to a feed cylinder to control weight on the drill bit.

In some embodiments, the hammer mode is implemented using: a set of max controllers, each max controller monitoring a feedback reference signal and decreasing feed relief when the monitored feedback signal exceeds a predefined setpoint; and a set of min controllers, each min controller monitoring a feedback reference signal and increasing feed relief when the monitored feedback signal falls below a predefined setpoint; wherein the feed relief signal is based on an output of one of the gain scheduling controller, a max controller, or the min controller.

In some embodiments, the computer program has instructions that when executed on the processor perform the further method steps of:

- implementing a state machine, wherein the state machine includes a find ground state, a release ground tension state, and a collaring state; and
- rotating the drill bit during the pause interval while in the collaring state.

In some embodiments, the hammer drilling mode is associated with a hammer drilling configuration, the hammer drilling configuration defining a set of hammer drilling parameters for use by the gain scheduling controller, the set of max controllers and the set of min controllers.

A second aspect of the present disclosure provides a method of controlling functionality of a drill rig, comprising:

- drilling a hole by repeatedly:
  - activating a hammer drilling mode for a predefined interval parameter, the activated hammer drilling mode causing a drill bit of the drill rig to impact a surface using a hammer drilling technique; and
  - activating a pause interval for a predefined interval time, during which the drill bit reduces engagement with the surface.

In some embodiments, the interval parameter is an interval depth to be drilled by the drill rig during each interval.

A third aspect of the present disclosure provides a drill control module for controlling operation of a drill rig in a hammer drilling mode, comprising:

a gain scheduling controller driven by an input air pressure value generated by a drill bit of the drill rig operating in the hammer mode, wherein the controller is utilised to generate a feed relief value for adjusting pressure applied to a feed cylinder to control weight on the drill bit;

a set of max controllers, each max controller monitoring a feedback reference signal and decreasing feed relief when the monitored feedback signal exceeds a predefined setpoint; and a set of min controllers, each min controller monitoring a feedback reference signal and increasing feed relief when the monitored feedback signal falls below a predefined setpoint;

wherein the feed relief signal is based on an output of one of the gain scheduling controller, a max controller, or the min controller.

In some embodiments, the hammer drilling mode is associated with a hammer drilling configuration, the hammer drilling configuration defining a set of hammer drilling parameters for use by the gain scheduling controller, the set of max controllers and the set of min controllers.

In some embodiments, the drill control module implements a state machine having a find ground state, a release ground tension state, and a collaring state.

A fourth aspect of the present disclosure provides a method for controlling a drill rig, comprising the steps of:

activating a hammer drilling mode for the drill rig, wherein the hammer drilling mode is associated with a hammer drilling configuration defining a set of parameters for use by a gain scheduling controller, a set of max controllers and a set of min controllers;

driving the gain scheduling controller with an input air pressure value generated by a drill bit of the drill rig operating in the hammer mode;

monitoring, using the set of max controllers, a first set of feedback reference signals and generating a max controller feed relief signal when at least one of the monitored feedback signals exceeds a predefined setpoint;

monitoring, using the set of min controllers, a second set of feedback reference signals and generating a min controller feed relief signal when at least one of the monitored feedback signal falls below a predefined setpoint;

generating a feed relief value for adjusting pressure applied to a feed cylinder to control weight on the drill bit, based on an output of one of the gain scheduling controller, the max controller feed relief signal, or the min controller feed relief signal.

In some embodiments, each max controller is a proportional controller that calculates an error between an input signal and a configured setpoint received by that max controller. In some embodiments, each min controller is a proportional controller that calculates an error between an input signal and a configured setpoint received by that min controller.

According to another aspect, the present disclosure provides an apparatus for implementing any one of the aforementioned methods.

According to another aspect, the present disclosure provides a computer program product including a computer readable medium having recorded thereon a computer program that when executed on a processor of a computer implements any one of the methods described above.

Other aspects of the present disclosure are also provided.

BRIEF DESCRIPTION OF THE DRAWINGS

One or more embodiments of the present disclosure will now be described by way of specific example(s) with reference to the accompanying drawings, in which.

Method steps or features in the accompanying drawings that have the same reference numerals are to be considered to have the same function(s) or operation(s), unless the contrary intention is expressed or implied.

DETAILED DESCRIPTION

Figure 1:
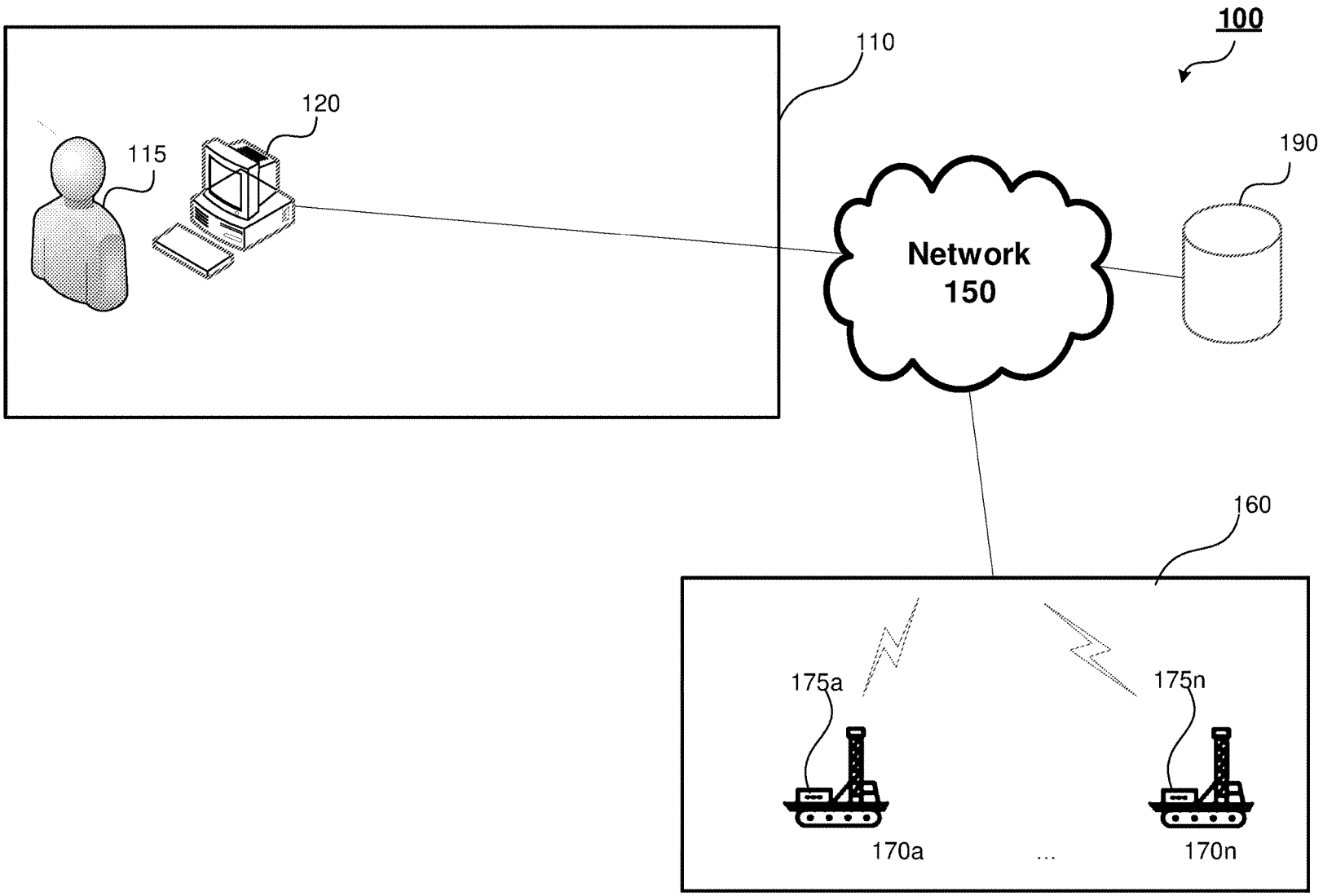
FIG. 1 is a schematic representation of a system on which one or more embodiments of the present disclosure may be practised.

The present disclosure provides a drill control method and system for controlling functionality of an autonomous drill rig. The drill control method and system utilise a controller that is used in combination with proportional controllers to generate a signal for controlling the amount of weight applied to a drill bit of an autonomous drill rig. In a hammer mode of drilling, the controller is driven by an input control signal related to an air pressure value generated by the drill rig. The proportional controllers ensure that the generated signal is within an operating range.

The present disclosure also provides a drill control method and system that implements an interval-based process in order to extract cuttings from a drill hole, particularly from a surface collaring operation performed using a hammer drilling mode.

In some embodiments, the control system includes a control centre for remotely controlling operation of the drill rig at a mine site that may be co-located with the control centre or remotely located from the control centre. The control centre includes a drill control station that is coupled to a control unit. The control unit is adapted to transmit information and instructions to the drill rig, via a wireless communications network.

Autonomous drill rigs are typically conventional blast hole drill rigs that have been retrofitted with automation technology that enable the drill rigs to perform one or more functions based on received computer commands, without requiring input from an onboard drill operator. Each autonomous drill rig is equipped with a drill control module that executes software for controlling functionality of the drill rig. Such autonomous drill rigs are monitored and controlled by a supervisory system, such as the control centre mentioned above.

The control centre controls the operation of drill rigs at one or more mine sites allocated to that remote control centre. The remote control centre is coupled to a communications network and sends information and commands via the communications network to a site controller at each mine site associated with the remote control centre. The site controller includes a wireless transmitter for transmitting wireless signals to drill rigs located at that mine site, with each drill rig being equipped with a wireless receiver.

The drill control module attached to each drill rig is adapted to control functionality of the drill rig, based on instructions received from a drill operator using a drill control station, measurement while drilling data (MWD), or a combination thereof. MWD is data collected from one or more sensors located on the drill rig or relates to calculated values calculated from inputs from those sensors. Examples of MWD include, but are not limited to, weight on bit, pulldown pressure, torque, rotation speed, penetration rate, adjusted penetration rate (APR), and specific energy of drilling (SED).

In the drill control method and system of the present disclosure, the drill control module is implemented using a computing device that is associated with a drill rig. The computing device is programmed to provide an improved drill control module for controlling a drill rig and may be implemented using, for example, a general purpose computer, programmable logic controller (PLC), or embedded computer. The drill control module utilises a state machine to control functionality of the drill rig, wherein software executing on a processor of the drill control module executes an algorithm to determine a current state of functionality for the drill rig.

Embodiments of the present disclosure include a drill control method and system that include a hammer drilling mode of operation. In the context of this specification, hammer drilling refers to down the hole (DTH) hammer drilling in which a percussive action is provided to a drill bit, in contrast to top hammer drilling in which a percussive action is provided to the top of a drill string.

When the drill control module is configured to operate in a rotary drilling mode, a main controller of the drill control module is driven by a rotation pressure value generated by a rotating drill bit, in order to generate a feed relief value that adjusts the pressure applied to a feed cylinder and to control the weight on the drill bit. In contrast, when the drill control module is configured to operate in the hammer drilling mode, the main controller is driven by an air pressure value generated by the drill bit operating in a hammer mode, in order to generate a feed relief value that adjusts the pressure applied to a feed cylinder and to control the weight on the drill bit.

Embodiments of a drill control method and system relating to a hammer drilling mode of operation utilise a gain scheduling controller that receives an air pressure value in order to generate the feed relief value that controls the weight applied to the drill bit. The gain scheduling controller operates in conjunction with a set of proportional controllers to ensure that the feed relief value that is presented to the feed cylinder to control the weight on the drill bit is within a predefined operating range.

Further embodiments of a drill control method and system include an interval drilling function, which is a process that can be implemented by the drill control module during a drilling operation. During a drilling mode of operation, the interval drilling function causes the drill rig to drill for a predefined drilling parameter before entering an interval phase. During the interval phase, the drill rig stops drilling for a predefined interval time or retracts a drill bit for a predefined interval time or predefined depth. The predefined drilling parameter may be, for example, a drilling time or a drilling depth. For example, the drilling parameter may be a drilling depth of 1 m, such that during an next cycle the drill rig drills to a depth of 1 m greater than a current drilled depth and then stops for a predefined interval time. Interval drilling provides an interval during which cuttings are removed from a hole during drilling.

FIG. 1 is a schematic block diagram representation of a system 100 in accordance with the present disclosure. The system 100 includes a remote control centre 110 for remotely operating control of drill rigs at one or more mine sites. The remote control centre 100 includes a drill control station 120 that is accessed by a drill controller 115 to monitor and control operation of drill rigs at remotely located mine sites. Whilst the example of FIG. 1 shows a single drill control station 120, other embodiments may include multiple drill control stations to allow contemporaneous access by multiple drill controllers.

Whilst the system 100 in the example of FIG. 1 shows a single mine site 160, the remote control centre 110 may be utilised to control multiple mine sites, with one or more autonomous drill rigs located at each mine site. Depending on the application, the remote control centre 110 may be co-located with a mine site 160 or alternatively may be located remotely, such as at a remotely location operations centre. In a large installation, different drill controllers utilise a set of drill control stations to control an allocated set of drill rigs across one or more mine sites.

The drill control station 120 is coupled to a communications network 150. The communications network 150 may be implemented utilising one or more wired communications links, wireless communications links, or any combination thereof. In particular, the communications network 150 may include a local area network (LAN), a wide area network (WAN), a telecommunications network, or any combination thereof. A telecommunications network may include, but is not limited to, a telephony network, such as a Public Switch Telephony Network (PSTN) or a cellular mobile telephony network, the Internet, or any combination thereof.

In the example of FIG. 1, the system 100 includes a mine site 160 that has a set of n drill rigs 170*a* . . . *n*. Each of the drill rigs 170*a* . . . *n* includes a corresponding drill control module 175*a* . . . *n* that controls operation of the respective drill rig 175*a* . . . *n*. The drill control modules 175*a* . . . *n* may be implemented using a computing device, such as a general purpose computer, a programmed logic controller, an embedded computer, or the like that is programmed to control operation of one or more functions of a drill rig, such as tramming, levelling, drilling, and the like.

Further, each of the drill rigs 170*a* . . . *n* includes a wireless transceiver for coupling the respective drill rig 170*a* . . . *n* to the communications network so as to enable communication between the drill control modules 175*a* . . . *n* and the drill control station 120.

The drill rigs 170*a* . . . *n* utilise the drill control modules 175*a* . . . *n* and the wireless transceivers to send information back to the remote control centre 110, such as information about the ground conditions, pressure on controls, and other measurement while drilling (MWD) data, such as drill bit pull down pressure and speed.

Further, each of the drill rigs 170*a* . . . *n* is capable of operating in an autonomous mode, based on instructions received from the drill control station 120. In autonomous mode, a drill rig may perform one or more functions in accordance with a drilling plan, such as tramming to a location for a next hole to be drilled, raising or lowering a mast associated with the drill rig, or drilling a hole, without having a drill operator on board to control operation of the drill rig. The drill control station 120 issues missions (e.g., a sequences of holes to be drilled autonomously, or discrete control commands for direct tele-remote control) to the drill control modules 175*a* . . . *n* to have the respective drill rigs 170*a* . . . *n* drill the sequence of holes or perform the discrete commands. Depending on the missions, instructions sent from the drill control station 120 may apply to a single drill rig, a set of drill rigs, or all of the drill rigs 170*a* . . . *n*.

The drill control station 120 provides the drill controller 115 with a user interface by which the drill controller 115 is able to monitor operation of the drills 170*a* . . . *n* and send commands to the drill rigs 170*a* . . . *n*. The drill controller 115 is able to access the drill control station 120 to send information and commands, via the communications network 150, to the drill control modules 175*a* . . . *n* of the drill rigs 170*a* . . . *n*. The information and commands may relate, for example, to a drilling plan. Thus, the drill controller 115 is able to utilise the drill control station 120 to prepare and allocate tasks to each of the autonomous drill rigs 170*a* . . . *n*.

While the drill controller 115 is able to monitor and control each of the autonomous drill rigs 170*a* . . . *n* from a remote location, the drill controller 115 may be assisted by an on-site drill patroller located at the mine site 160. The drill patroller can perform on-site visual inspections of the drill rigs 170*a* . . . *n* and the mine site itself and inform the drill controller 115 of any issues.

Each drill control module 175*a* . . . *n* is adapted to control behaviour of the corresponding drill rig 170*a* . . . *n* utilising a state machine that controls functionality performed by the respective drill rig 170*a* . . . *n*. A drill operator selects, from a set of available drilling configurations, a drilling configuration to be implemented by a drill rig. Selecting a drilling configuration causes a set of parameters associated with the selected drilling configuration to be loaded into the drill control module to apply the selected drilling configuration to the drill rig. A drilling configuration may relate, for example, to a mode of drilling, such as rotary drilling or hammer drilling, and the associated parameters may include, for example, a state machine.

While the system 100 in the example of FIG. 1 shows a single mine site 160, the remote control centre 110 may be utilised to control multiple mine sites, with one or more drill rigs located at each mine site. Depending on the application, the remote control centre 110 may be co-located with the mine site 160 or alternatively may be located remotely, such as at a remotely location operations centre. The example of FIG. 1 also shows an optional configuration database 190, which can be used to store data relating to the configuration of each mine site 160.

Figure 3:
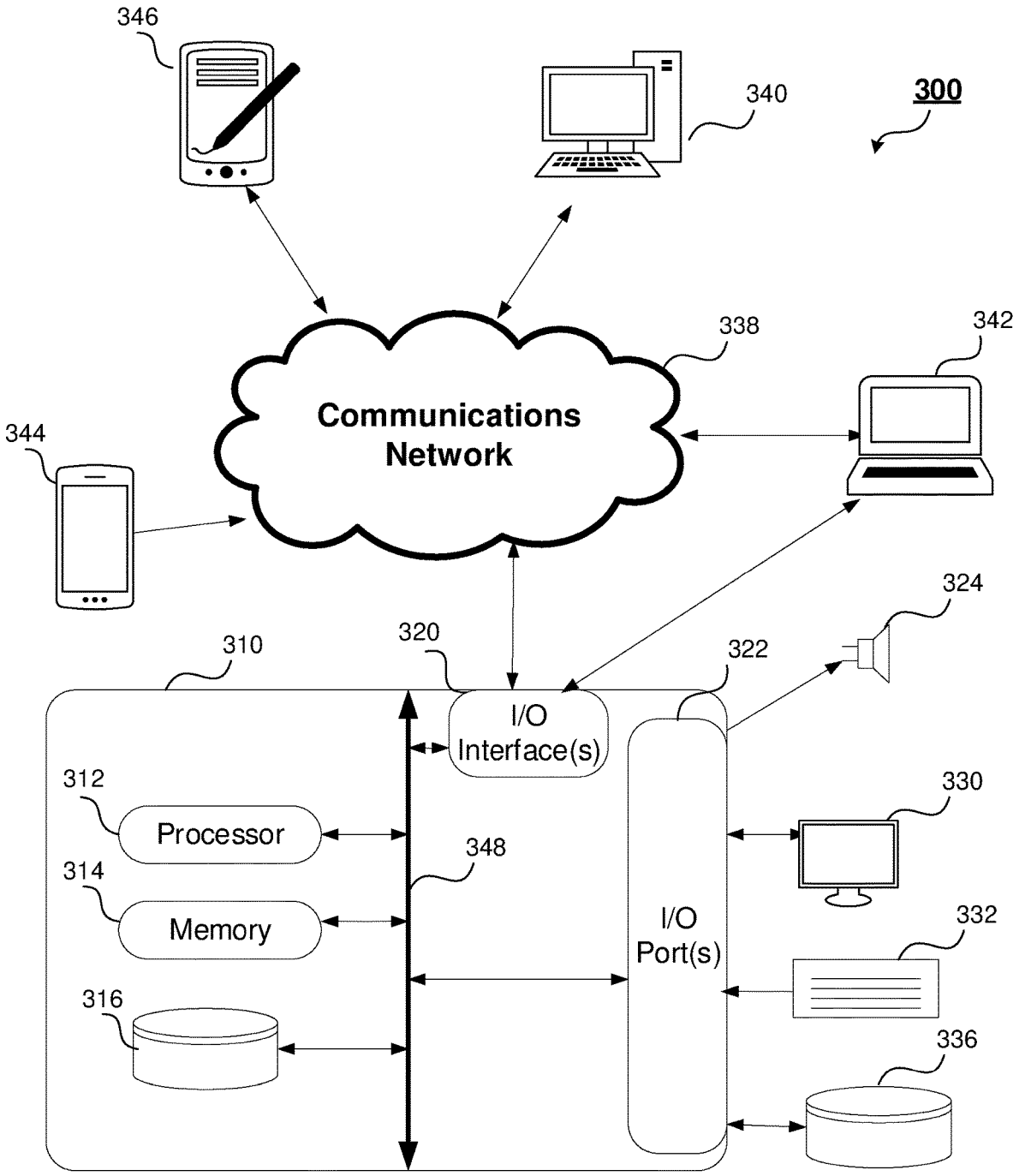
FIG. 3 is a schematic block diagram representation of a system that includes a general purpose computer on which one or more embodiments of the present disclosure may be practised.

Various drill functionality of an autonomous drill rig is controlled by a drill control module, such as the drill control modules 175*a* . . . *n* of FIG. 1. The drill control module may be implemented using one or more computing devices, such as a general purpose computer, computer server, or programmable logic device (PLD) programmed and adapted to function in an improved manner. FIG. 3 is a schematic block diagram representation of a system 300 that includes a general purpose computer 310. The general purpose computer 310 includes a plurality of components, including: a processor 312, a memory 314, a storage medium 316, input/output (I/O) interfaces 320, and input/output (I/O) ports 322. Components of the general purpose computer 310 generally communicate with each other using one or more buses 348.

The memory 314 may be implemented using Random Access Memory (RAM), Read Only Memory (ROM), or a combination thereof. The storage medium 316 may be implemented as one or more of a hard disk drive, a solid state "flash" drive, an optical disk drive, or other storage means. The storage medium 316 may be utilised to store one or more computer programs, including an operating system, software applications, and data. In one mode of operation, instructions from one or more computer programs stored in the storage medium 316 are loaded into the memory 314 via the bus 348. Instructions loaded into the memory 314 are then made available via the bus 348 or other means for execution by the processor 312 to implement a mode of operation in accordance with the executed instructions.

One or more peripheral devices may be coupled to the general purpose computer 310 via the I/O ports 322. In the example of FIG. 3, the general purpose computer 310 is coupled to each of a speaker 324, a display device 330, an input device 332, and an external storage medium 336. The speaker 324 may be implemented using one or more speakers, internal to the computing device 310 or external to the computing device 310, such as in a speaker attached to an autonomous drill rig.

The display device 330 may be a computer monitor, such as a cathode ray tube screen, plasma screen, or liquid crystal display (LCD) screen. The display 330 may receive information from the computer 310 in a conventional manner, wherein the information is presented on the display device 330 for viewing by a user. The display device 330 may optionally be implemented using a touch screen to enable a user to provide input to the general purpose computer 310. The touch screen may be, for example, a capacitive touch screen, a resistive touchscreen, a surface acoustic wave touchscreen, or the like. In the example in which the general purpose computer 310 is utilised to implement the drill control module 175*a* of FIG. 1, the display device 310 may display a user interface for receiving inputs from a drill operator or site controller and display information relating to the operation and control of the drill rigs 170*a*. Depending on the implementation, the display device 310 may be located at a drill control station 120 remote from an autonomous drill rig 170*a* on which the drill control module 175*a* is installed.

The input device 332 may be a keyboard, a mouse, a stylus, drawing tablet, or any combination thereof, for receiving input from a user. The external storage medium 336 may include an external hard disk drive (HDD), an optical drive, a floppy disk drive, a flash drive, solid state drive (SSD), or any combination thereof and may be implemented as a single instance or multiple instances of any one or more of those devices. For example, the external storage medium 336 may be implemented as an array of hard disk drives.

The I/O interfaces 320 facilitate the exchange of information between the general purpose computing device 310 and other computing devices. The I/O interfaces may be implemented using an internal or external modem, an Ethernet connection, or the like, to enable coupling to a transmission medium. In the example of FIG. 3, the I/O interfaces 322 are coupled to a communications network 338 and directly to a computing device 342. The computing device 342 is shown as a personal computer, but may be equally be practised using a smartphone, laptop, or a tablet device. Direct communication between the general purpose computer 310 and the computing device 342 may be implemented using a wireless or wired transmission link.

The communications network 338 may be implemented using one or more wired or wireless transmission links and may include, for example, a dedicated communications link, a local area network (LAN), a wide area network (WAN), the Internet, a telecommunications network, or any combination thereof. A telecommunications network may include, but is not limited to, a telephony network, such as a Public Switch Telephony Network (PSTN), a mobile telephone cellular network, a short message service (SMS) network, or any combination thereof. The general purpose computer 310 is able to communicate via the communications network 338 to other computing devices connected to the communications network 338, such as the mobile telephone handset 344, the touchscreen smartphone 346, the personal computer 340, and the computing device 342.

One or more instances of the general purpose computer 310 may be utilised to implement a drill control station, site controller, remote centre controller, and/or drill control module in accordance with the present disclosure. In such an embodiment, the memory 314 and storage 316 are utilised to store data relating to the configuration of drills at one or more mine sites, the allocation of drill rigs to one or more button modules, and programs for controlling functionality of the drill rigs 170*a . . . n*. Software for implementing the control system is stored in one or both of the memory 314 and storage 316 for execution on the processor 312. The software includes computer program code for implementing method steps in accordance with drill control system described herein.

Figure 4:
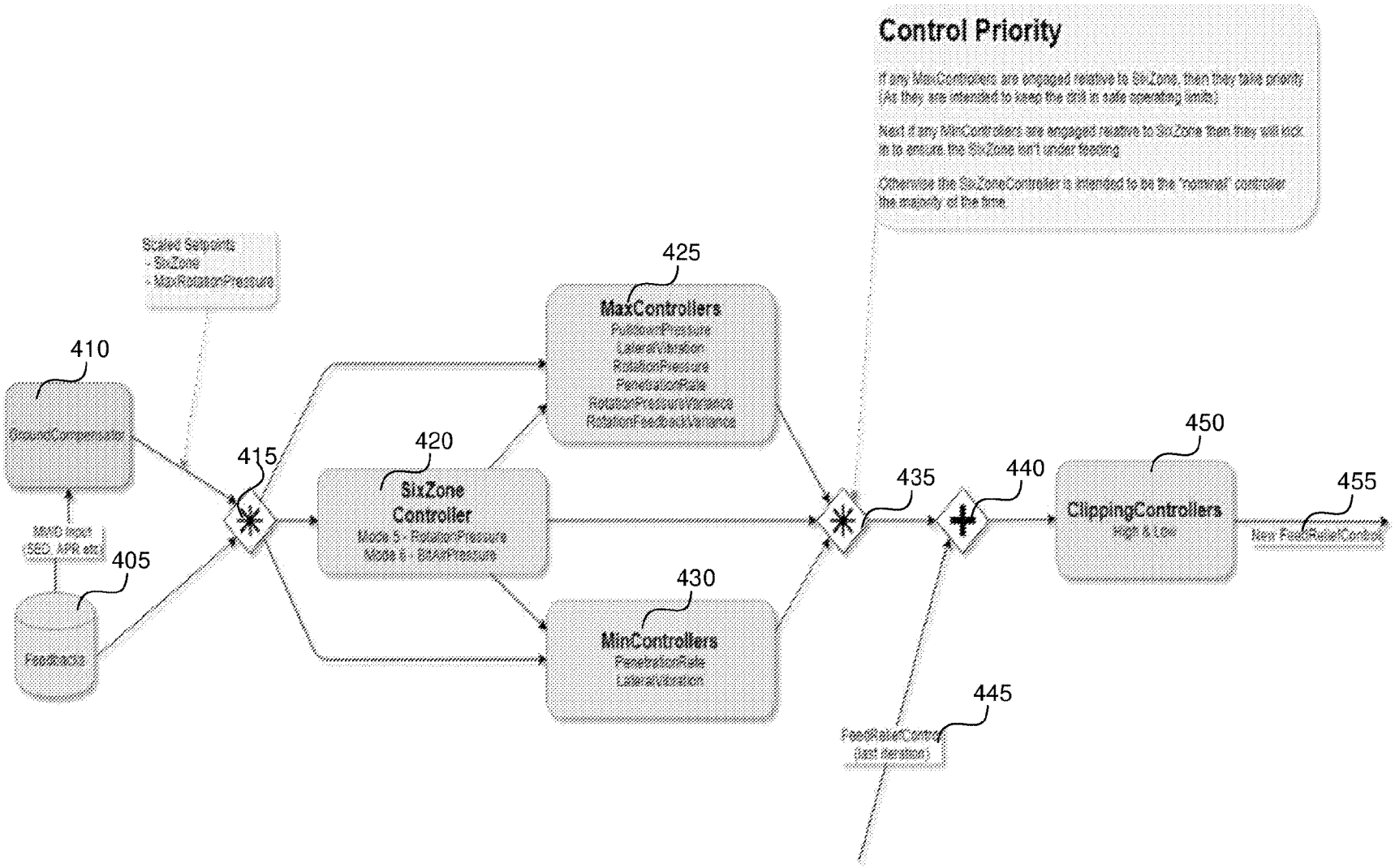
FIG. 4 is a schematic block diagram representation of a control system for an autonomous drill rig.

FIG. 4 is a schematic block diagram representation of data flow 400 during a hammer drilling mode and a rotary drilling mode in order to generate a new feed relief control value. As described above, the feed relief value is used to adjust the pressure applied to a feed cylinder and to control the weight on the drill bit during a drilling operation. During a rotary drilling mode, a controller is driven by a rotation pressure value generated by a rotating drill bit. During a hammer drilling mode, a controller is driven by an air pressure value generated by the drill bit operating in a hammer mode.

Figure 6:
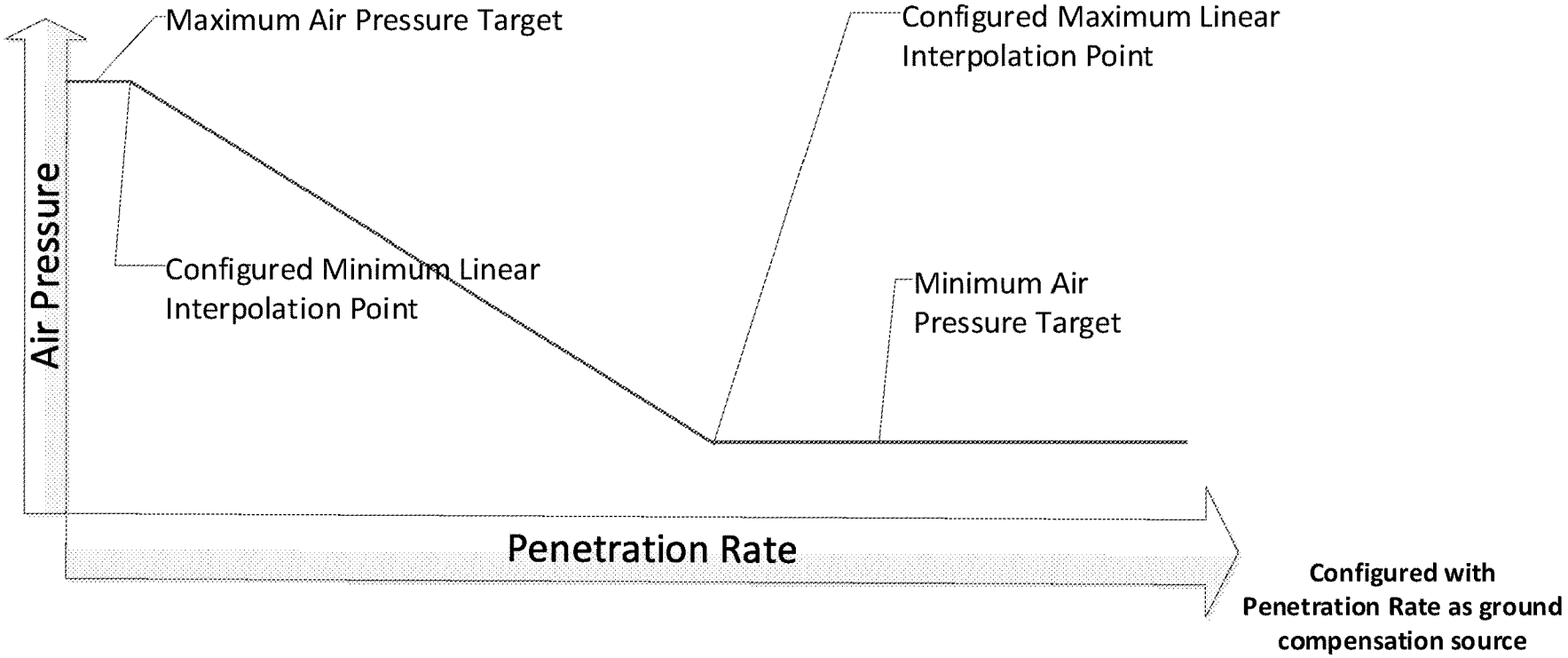
FIG. 6 illustrates an example of a ground compensator scaling an air pressure setpoint using penetration rate.

A feedback database 405 presents MWD data, such as SED and APR, to a ground compensator 410. The ground compensator uses an input parameter, such as the MWD data, to estimate the ground conditions. Typically, the estimation relates to how hard the ground is. This input parameter is then used as an input to a function to scale target setpoints inside the algorithm to better adapt to these conditions. The scaling function is configurable per drilling configuration and is a linear mapping from the input variable to a scaled setpoint. FIG. 6 illustrates an example for air pressure setpoint using penetration rate and the input parameter.

The ground compensator 410 outputs scaled setpoints including SixZone and MaxRotationPressure to a first consolidation point 415, which also receives as input a set of feedback parameters from the feedback database 405, wherein the feedback parameters are data derived from sensors on the drill rig or are calculated metrics based on input derived from outputs of the sensors.

The output of the first consolidation point 415 is presented as an input to each of a SixZone controller 420, a set of MaxControllers 425, and a set of MinControllers 430. The SixZone controller 420 implements GainScheduling, wherein the scheduling is based on a current input signal (e.g., rotation pressure, air pressure) dependent on a mode of operation. The SixZone controller 420 configures six distinct zones, defined by a lower border, an upper border, and a size above and below a configured setpoint. The SixZone controller 420 is capable of operating in either a rotary drilling mode using rotation pressure as a current input signal or a hammer drilling mode using bit air pressure as a current input signal, wherein the configuration of the SixZone controller 420 is set when an operator selects a drilling configuration.

The SixZone controller 420 produces an output to each of the set of MaxControllers 425, the set of MinControllers 430, and a decision block 435. The controllers impose various constraints on the system, such as a maximum pulldown pressure, and activate controls in lieu of the SixZone controller 420.

A MaxController is a proportional controller that calculates the error between an input signal and a configured setpoint. If the MaxController determines that the error is positive (i.e., the input signal is greater than the configured setpoint), the MaxController 'engages'. Once engaged, the MaxController will calculate the error between the input signal and the configured setpoint minus a release offset. The error is multiplied by a configured gain to produce an output that is used in further control decisions. If the controller is not engaged, an output signal of 0.0 (corresponding to "no output") is provided. The controller, if engaged, will disengage when the input signal is below the configured setpoint minus the release offset.

Based on the configured mode of drilling (e.g., hammer drilling), a subset of the available MaxControllers will be active, and only the active MaxControllers will have their outputs ("max controller feed relief signals") considered in further calculations. When the drilling algorithm looks at all the active max controller outputs, the drilling algorithm selects the highest output of all the MaxControllers. If this selected output is higher than the output of the SixZone controller, then the selected MaxController output is subtracted from the feed relief. If the SixZone controller output is higher, the algorithm instead subtracts the SixZone controller output from the feed relief. This in effect reduces the force on the bit.

The set of MaxControllers 425 includes a PullDownPressure, LateralVibration, RotationPressure, PenetrationRate, RotationPressureVariance, and RotationFeedbackVariance. Each of the MaxControllers 425 works on different feedback in accordance with a particular configuration. The set of MaxControllers 425 presents an output to the decision block 435.

The set of MinControllers 430 includes each of a Penetration Rate and Lateral Vibration and produces an output to the decision block 435. Each of the MinControllers 430 monitors a feedback reference signal and increases feed relief when the monitored feedback falls below a predefined setpoint. For example, the PenetrationRate MinController monitors a penetration rate of drilling by the drill rig. When the penetration rate falls below a predefined penetration rate setpoint, the PenetrationRate MinController increases the feed relief.

The MinController, like the Max controller, is also a proportional controller which calculates an error between an input signal and a configured setpoint. If the error is negative (i.e., the input signal is less than the configured setpoint), the MinController will engage, but only if a reference input signal is below the reference setpoint. In all the MinControllers for hammer drilling, the reference signal is the feed relief control signal. The purpose of this is to only engage MinControllers when the feed relief is below a certain limit. This is to cater for scenarios where using air pressure and the SixZone controller alone is not enough to drive the correct hammer behaviour in particular ground conditions.

Once the MinController is engaged, the error is calculated by taking the input signal and subtracting the configured setpoint and release offset. The error is multiplied by a configured gain to produce an output. If the reference signal equals or exceeds the reference setpoint or the input signal equals or exceeds the configured setpoint plus release offset, the MinController disengages.

Based on the configured mode of drilling, e.g. hammer drilling, a subset of the available MinControllers will be active, and only the active MinControllers will have their outputs ("min controller feed relief signals") considered in further calculations.

When the drilling algorithm looks at all the active MinController outputs, the algorithm selects the lowest output of all the MinControllers. If this selected output is lower than the SixZone controller output, then the selected MinController output is subtracted from the feed relief (note the error when the min controller is active is negative, so this in effect increases the force on bit). The MinController output is only considered if no MaxController output is present. If no MaxController output or MinController output is present, the SixZone controller output is used.

The decision block 435 decides which controller should have its output applied to the feed relief control. Only one controller will have its output applied and the decision block 435 determines which output will be applied. The SixZone Controller 420 is the default "nominal" controller the majority of the time. However, if any module of the MaxController 425 is engaged relative to the SixZone Controller 420, then the engaged module of the MaxController 425 takes priority. Further, if either module of the MinController 430 is engaged relative to the SixZone Controller 430, then the engaged module of the MinController 430 will kick in to ensure that the SixZone Controller 430 is not under feeding. Further detail regarding the operation of decision block 435 is illustrated in, and described with reference to, FIG. 2*a*.

Some embodiments utilise a configured value EngagedFactorThreshold to prioritise between the SixZoneController 420 and the MinControllers 430 and the MaxControllers 425. If the EngagedFactorThreshold is zero, then the control, corresponding to an output of the MaxControllers or MinControllers just has to exceed the output of the SixZone Controller 420. This means the MaxControllers 425 have to try and drive the FeedRelief lower than what the SixZone Controller 420 is commanding. The MinControllers 430 have to try and drive the FeedRelief higher than the SixZone Controller 420.

The MaxControllers 425 always take precedence for safety reasons, to try and always preference under feeding if required. So if any MaxController 425 has engaged (meaning its feedback is greater than a predefined setpoint), that MaxController 425 takes precedence over all other controllers, with the exception of if the SixZone Controller 420 is trying to reduce FeedRelief at a quicker rate. If no MaxControllers 425 are engaged, then the drill control module determines if any MinControllers 430 are engaged, otherwise control will fall to the SixZoneController 420.

If the EngagedFactorThreshold is 1, then the Min/Max Controller has to be at least double the output of the SixZone Controller 420 to take control. If the EngagedFactorThreshold is 0.5, then then Min/Max Controller has to be at least the same magnitude output as the SixZone Controller 420 to take control. The EngagedFactorThreshold value is configured inside the chosen drilling configuration and are tuned based on the controller to achieve a desired response.

The decision block 435 presents an output to an adder 440, which also receive an input corresponding to FeedReliefControl 445 from a preceding iteration. The adder 440 presents an output as an input to a ClippingControllers module 450, which applies high and low clipping and presents an output in the form of a New FeedReliefControl signal 455. The ClippingControllers module 450 ensures that the output feed relief control signal is within a sensible range for control in a scenario where feed relief control wind-up occurs. The New FeedReliefControl signal 455 is used by the drill control module to adjust the pressure applied to a feed cylinder and to control the weight on the drill bit during the drilling operation.

Figure 2A:
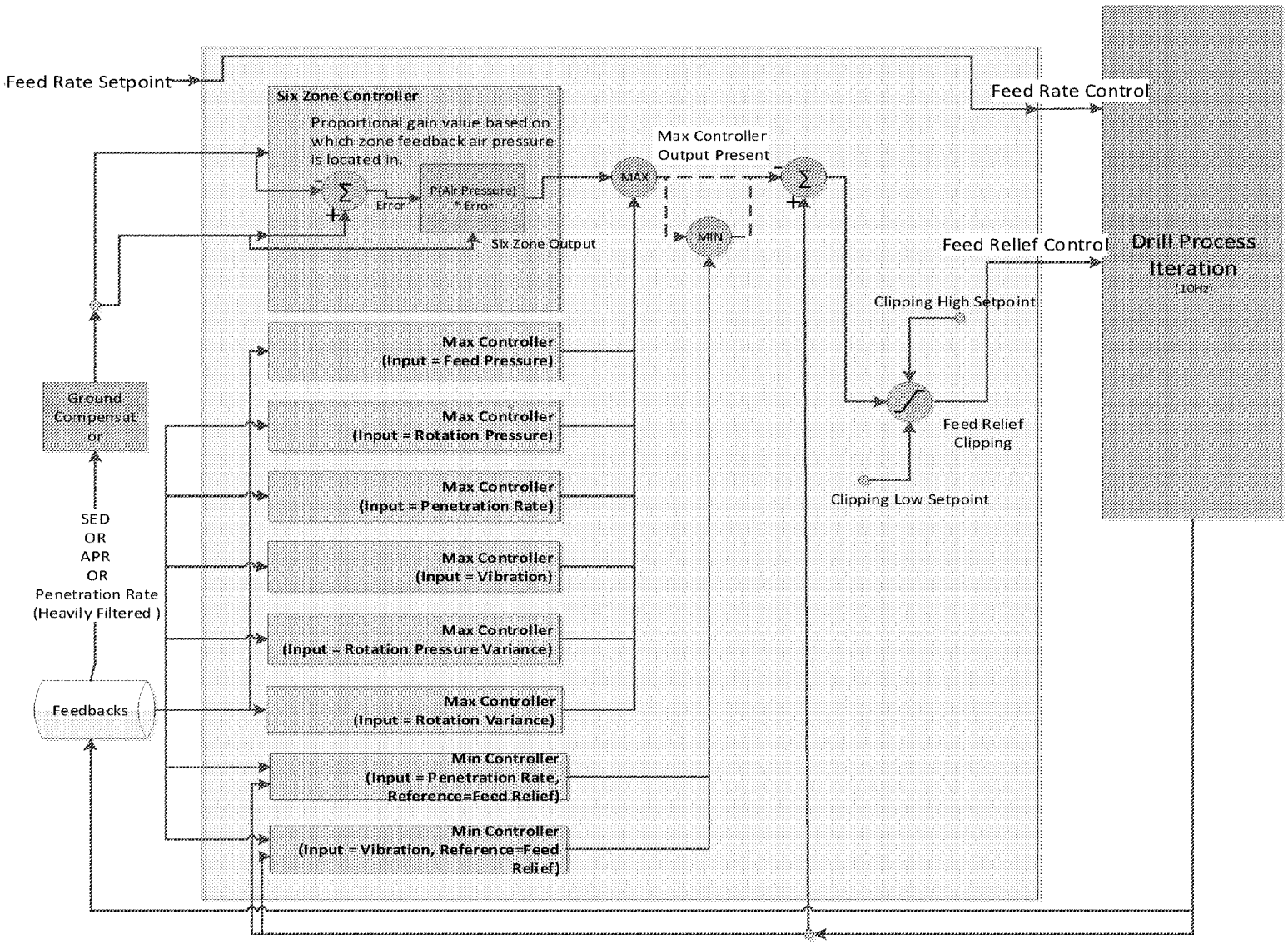
FIG. 2*a* is a schematic block diagram representation of functional modules of a Feed Controller controlled by air pressure for use in a hammer drilling mode of operation.

FIG. 2*a* is a schematic block diagram representation of functional modules of a Feed Controller controlled by air pressure for use in a hammer drilling mode of operation. The Feed Controller includes a SixZone Controller, a set of Max Controllers, a set of Min Controllers, and Clipping Controllers.

As described in relation to FIG. 4, a Feedbacks module presents MWD data (e.g., SED, APR, Penetration Rate) to a Ground Compensator. The Ground Compensator generates a scaled Air Pressure Setpoint and presents the Air Pressure Setpoint as an input to a SixZone Controller of a Feed Controller. The Feed Controller also receives a Feed Rate Setpoint, that is passed through as a Feed Rate Control output signal to a drill process iteration (operating at 10 Hz).

The SixZone Controller has six zones of operation and utilises a proportional gain value based on which zone feedback air pressure is located in. The SixZone Controller generates an Error value from the received Air Pressure Setpoint (wherein error=input signal−setpoint) and calculates P(Air Pressure)*Error to generate a SixZone Output that is presented to a decision state.

The Feedback module presents drilling parameters to each Max Controller and each Min Controller. In the example of FIG. 2*a*, the set of Max Controllers includes 6 Max Controllers that receive Rotation Pressure, Penetration Rate, Vibration, Rotation Pressure Variance, and Rotation Variance, respectively. Each Max Controller processes the received input signal to determine if that Max Controller is engaged to control the drilling operation. The outputs of the Max Controllers are presented to the decision state. If no Max Controller has an output >0.0, then the output of the SixZone Controller is utilised and passed to a Min Controller Check. If a Max Controller output is present, the Min Controller check is bypassed.

In the example of FIG. 2*a*, the set of Min Controllers includes 2 Min Controllers. A first Min Controller receives an input of Penetration Rate and a reference signal of Feed Relief and a second Min Controller receives an input of Vibration and a reference signal of Feed Relief. The outputs of the Min Controllers are presented to a decision state. If no Min Controller has an output <0.0, the output of the SixZone controller is passed through. The passed through value is summed with a Prior Feed Relief Control Signal and the summed output is presented to a ClippingControl that has receives a Clipping Low Setpoint and a Clipping High Setpoint to filter the signal and output a Feed Relief Signal to a Drill Process Iteration.

On a first iteration, input may be provided by configuration settings or from a last controller state output. After the first iteration, the feed controller output is used as an input for a next iteration.

Figure 2B:
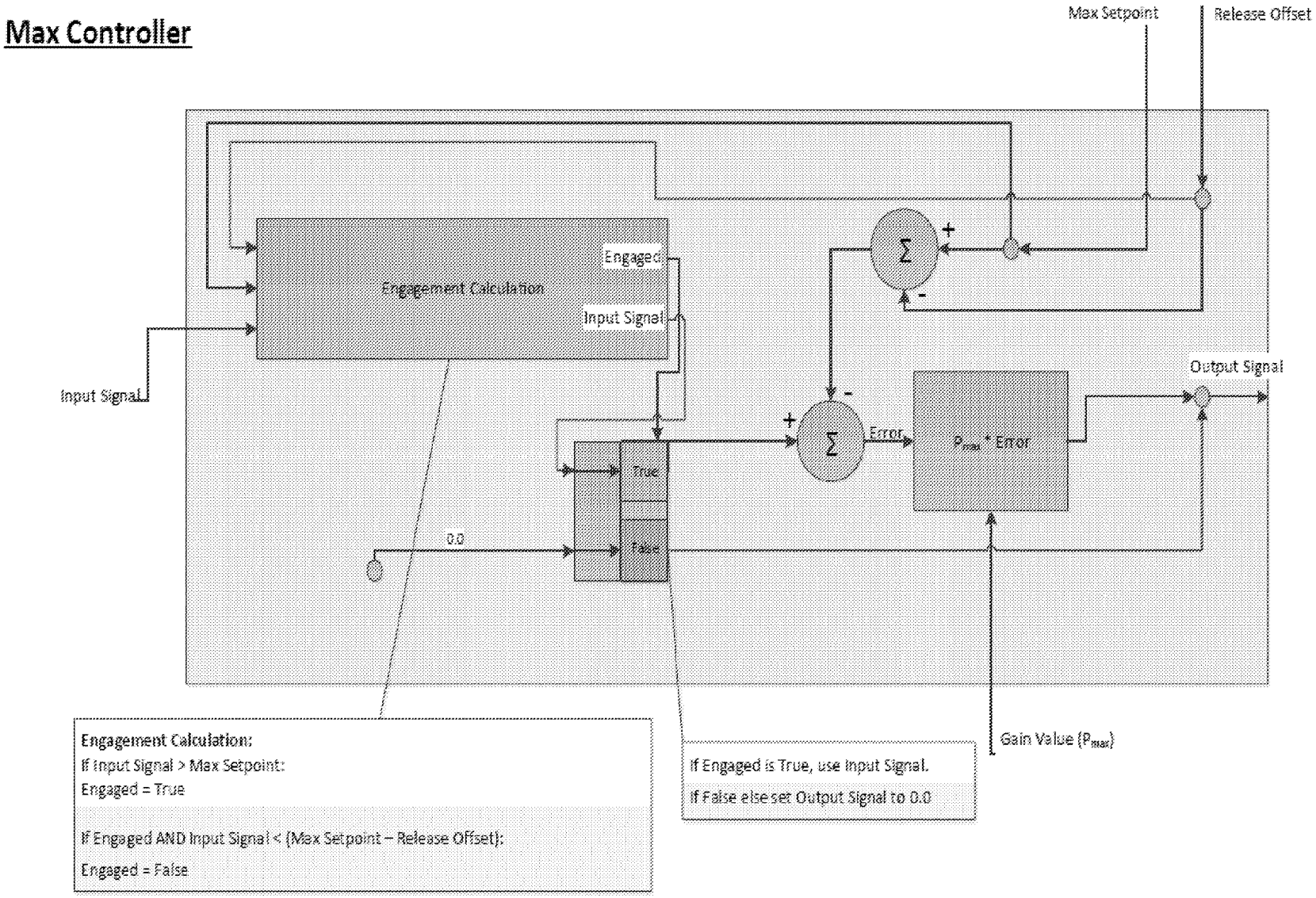
FIG. 2*b* is a schematic block diagram representation of a MaxController.

FIG. 2*b* is a schematic block diagram representation of a MaxController. The MaxController receives as inputs an Input Signal, a Gain Value (Pmax), a Max Setpoint, and a Release Output and generates an Output Signal. The Input Signal is presented to an Engagement Calculation Unit, which also receives the Max Setpoint and the Release Offset. If the Input Signal is greater than the Max Setpoint, then Engaged is set to True. If Engaged AND Input Signal<(Max Setpoint−Release Offset), then Engaged is set to False.

The Engagement Calculation Unit outputs the value of Engaged and the Input Signal as inputs to a comparator that also receives an input of 0.0. If Engaged is True, then then the comparator outputs the Input Signal. If Engaged is False, the comparator outputs an output signal of 0.0.

The Release Offset and Max Setpoint are presented to a first adder and the sum is presented to a second adder that also receives as input the output of the comparator. The output of the second adder is presented as an Error value to a multiplier. The multiplier receives the Gain Value (Pmax) and multiplies the Gain Value by the Error to produce the Output Signal for the MaxController.

Figure 2C:
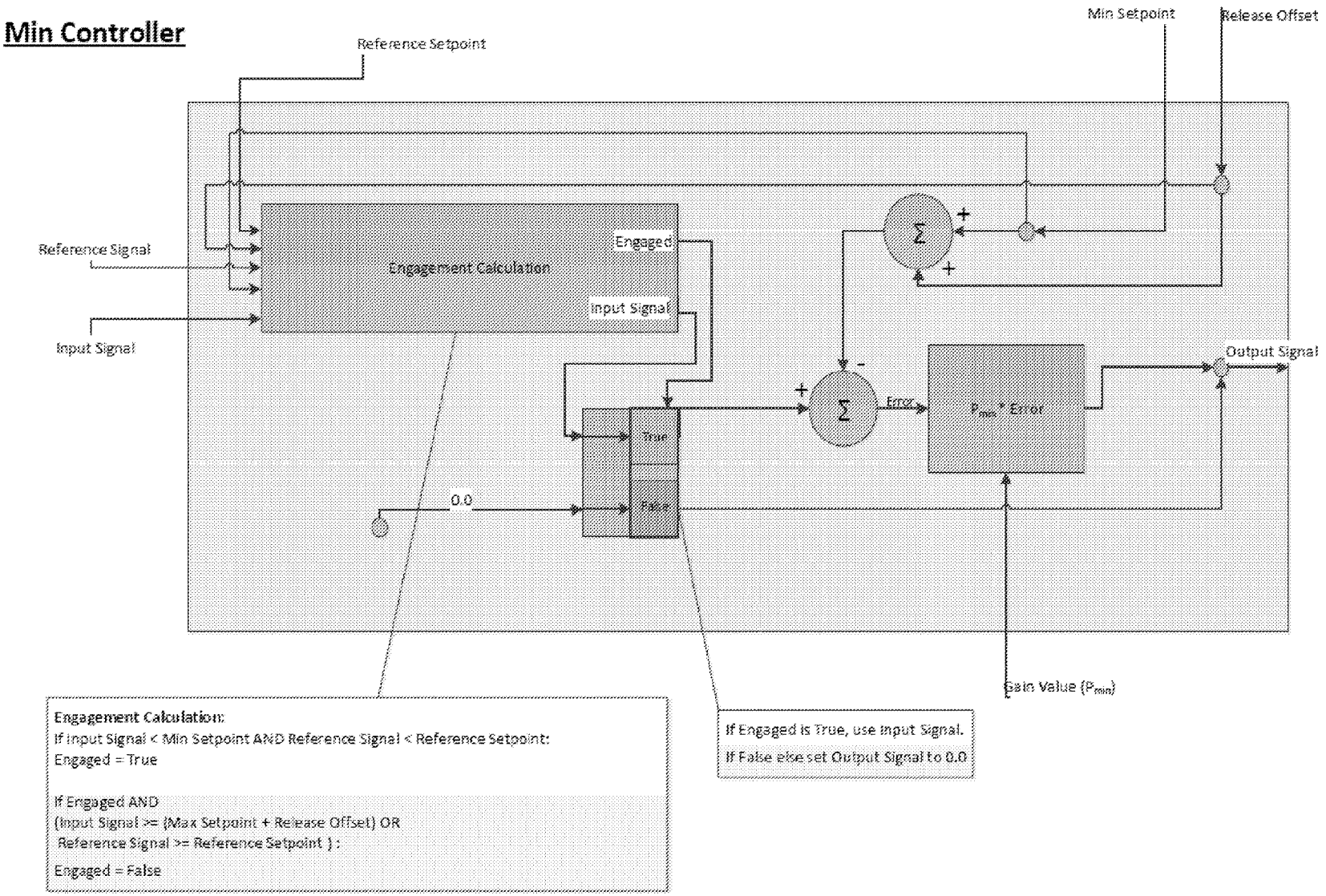
FIG. 2*c* is a schematic block diagram representation of a MinController.

FIG. 2*c* is a schematic block diagram representation of a MinController. The MaxController receives as inputs an Input Signal, a Reference Signal, a Reference Setpoint, a Gain Value (Pmin), a Min Setpoint, and a Release Output and generates an Output Signal.

The Input Signal, Reference Signal, Reference Setpoint, Min Setpoint and Release Offset are presented as inputs to an Engagement Calculation Unit, which determines whether to engage the MinController.

If Input Signal<Min Setpoint AND Reference Signal<Reference Setpoint, then Engaged is set to True.

If Engaged AND (Input Signal>=(Max Setpoint+Release Offset) OR Reference Signal>=Reference Setpoint), then Engaged is set to False.

The Engagement Calculation Unit outputs the value of Engaged and the Input Signal as inputs to a comparator that also receives an input of 0.0. If Engaged is True, then then the comparator outputs the Input Signal. If Engaged is False, the comparator outputs an output signal of 0.0.

The Release Offset and Min Setpoint are presented to a first adder and the sum is presented to a second adder that also receives as input the output of the comparator. The output of the second adder is presented as an Error value to a multiplier. The multiplier receives the Gain Value (Pmin) and multiplies the Gain Value by the Error to produce the Output Signal for the MinController.

As indicated above, some embodiments of the drill control method and system include an interval drilling function, whereby a drilling mode of operation is programmed to drill for a predefined drilling interval depth before stopping drilling for a predefined interval time. Such interval drilling may be implemented by the drill control module during a drilling operation.

During a drilling mode of operation, the interval drilling function causes the drill rig to drill for a predefined drilling parameter before entering an interval phase. In some embodiments, the drilling parameter is an interval depth.

The interval depth is configurable via a DrilledDepthInterval configuration key. In some embodiments, the interval depth is 1 m relative to a current depth. A target state is configurable in a TransitionTable to change controller behaviour for different drilling profiles.

For example, when the autonomous drill rig is operating in a hammer drilling mode, the drill control module disables rotation of the drill bit during surface collaring (a sub-state of collaring), which is important so that the drill bit doesn't skew off vertical while establishing the top of hole. Ensuring that the drill bit is vertical during collaring helps produce a straight hole, which minimises bogging.

Interval drilling controls a hammer drilling mode such that the drill rig drills a hole in a hammer drilling mode for a predefined interval parameter, such as an interval depth, and then stops for a predefined interval time, which provides time to allow air pressure within the hole to bail out the cuttings.

In one example, a drill rig is set to drill at interval depths of 10 cm during surface collaring, which will occur up until 0.35 m down the hole. In the hammer configuration, the drill bit is raised at only a very slight rate (1 mph) during the interval. This is to remove the weight from the bit. The control flow may be presented as:

TABLE 1

| |
|---|
| Surface collar to 0->10 cm |
| (interval event) |
| ReleaseTensionGround |
| (time passed event) |
| Surface collar 10->20 cm |
| (interval event) |
| ReleaseTensionGround |
| (time passed event) |
| Surface collar 20->30 cm |
| (interval event) |
| ReleaseTensionGround |
| (time passed event) |
| Surface collar 30->35 cm |
| (surface collaring complete event) |
| ReleaseTensionGround |
| (time passed event) |
| Collaring [rotation is added to drill string in this state] |

In other configurations, the drill bit could be retracted at a faster rate or instead of waiting for a period of time the drill bit instead retracts to a set depth. For example, the drill rig can be configured to drill 1 m, retract 1 m, then drill 1 m more and so forth.

To achieve this bailing of cuttings, the drill control module utilises a ReleaseTensionGround algorithm, which runs the FeedController in a very low fixed rate (1 mph) for a fixed interval of time (4 seconds). ReleaseTensionGround is a state in the drilling state machine. ReleaseTensionGround applies closed loop control over the feed control (different to feed relief) to achieve a desired speed. The ReleaseTensionGround state itself is only active for a configured time, so the closed loop controller only acts over that duration. After the configured time for the state has elapsed, control transitions back to the collaring state. This is repeated for the remainder of the collaring depth.

Figure 5:
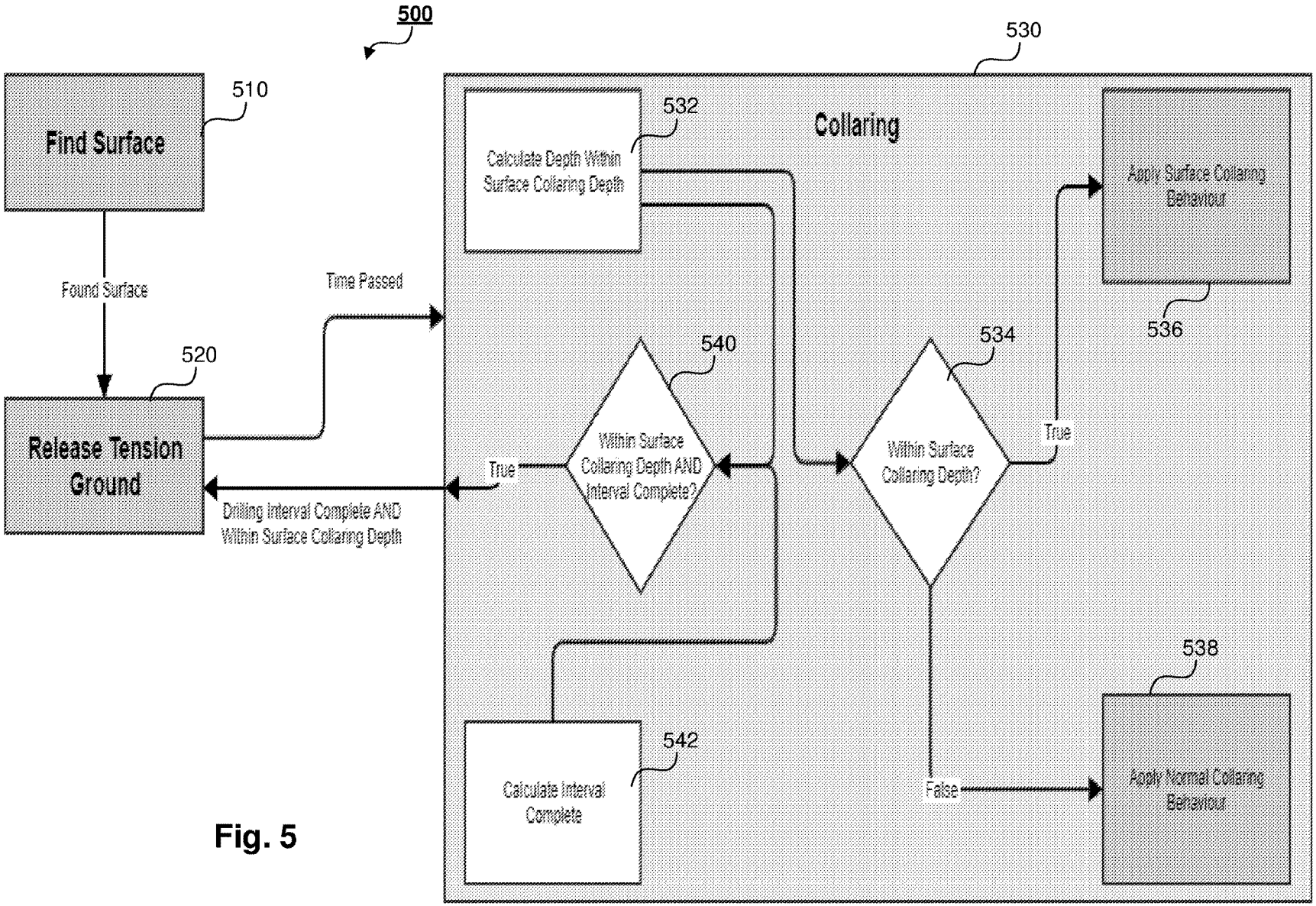
FIG. 5 is a schematic block diagram representation of control flow for interval drilling functionality of an autonomous drill rig.

FIG. 5 is a schematic flow diagram 500 representing an example of interval drilling. As described above, a drilling configuration may be associated with a state machine. In the example of FIG. 5, the drill rig is drilling a new blast hole and the drill control module has activated interval drilling. An initial Find Surface state 510 identifies a ground surface. Once the surface has been found, flow transitions to a Release Tension Ground state 520. Once a predefined period of time has passed, flow transitions to a Collaring state 530.

The Collaring state 530 includes an Apply Surface Collaring Behaviour sub-state 536 and an Apply Normal Collaring Behaviour state 538. On entering the Collaring state 530, the Collaring state 530 uses a first calculation state 532 to calculate whether a current depth is within an initial Surface Collaring Depth. As described in the example above, a surface collaring depth of 0.35 m may be set. The calculated Boolean output of the first calculation state 532 is presented to each of first and second decision states 534, 540. The first decision state 534 checks if the depth is within the Surface Collaring Depth and if so, True, control passes from the first decision state 534 to the Apply Surface Collaring Behaviour sub-state 536. The Apply Surface Collaring Behaviour sub-state 536 relates to specific drilling practices performed at the very surface of a bench. During this sub-state 536, the drill control module applies low pressure to the hammer, in order to deal with the loose rocks on the surface that could lead to hole deviation.

During surface collaring, interval drilling causes the drill bit to "feather" the surface by repeatedly applying light drill pressure to the surface until an interval depth has been achieved, such as 10 cm, and then pausing for an interval to allow cuttings in the hole to be evacuated by air pressure, before repeating the drilling and interval pause until a predefined surface collaring depth is achieved.

Once the Apply Surface Collaring Behaviour sub-state 536 has drilled according to an interval parameter, such as an interval depth of 10 cm, drilling stops for a predefined interval time. Control then passes to the Release Tension Ground state 520 for a predefined time period, before control returns to the Collaring state 530.

The Collaring state 530 again calculates, using the first calculation state 532, whether a current depth is within the Surface Collaring Depth and passes the Boolean output to the first and second decision states 534, 540. If the first decision state 534 determines that the depth is still within the Surface Collaring Depth, True, control again passes to the Apply Surface Collaring Behaviour sub-state 536 and another surface collaring iteration occurs. However, if the first decision state determines that the calculated depth is not within the Surface Collaring Depth, No, control passes from the first decision state 534 to the Apply Normal Collaring Behaviour sub-state 538.

During the Apply Normal Collaring Behaviour sub-state 538, the drill rig applies more pressure to the drill bit. During Apply Normal Collaring Behaviour sub-state 538, interval drilling may or may not be utilised, depending on the particular application. For example, interval drilling may be limited to the Apply Surface Collaring Behaviour sub-state 536. If interval drilling is applied to the Apply Normal Collaring Behaviour sub-state 538, the interval depth associated with the Apply Normal Collaring Behaviour state 538 may be larger than the interval depth associated with the Apply Surface Collaring Behaviour state 536. Once the drill rig has drilled for an interval parameter associated with normal collaring, such as an interval depth, then drilling pauses for an interval time and control then passes to the Release Tension Ground state 520. After a predefined time period has passed, control returns to the Collaring state 530.

As described above, the Collaring state 530 at first calculation state 532 calculates a depth with the Surface Collaring Depth and presents the calculated depth to each of the first decision state 534 and the second decision state 540. A second calculation state 542 calculates whether an interval has been completed and passes an Interval Complete output to the second decision state 540. The second decision state 540 determines whether the depth is within the Surface Collaring Depth and the Interval is complete and when True presents an output signal as an input to the Release Tension Ground state 520.

The second decision state 540 is the logic that must occur to allow a state machine transition from the Collaring state 530 to the Release Tension Ground state 520 when "interval drilling", based on a configured state machine for hammer drilling. If the drill rig is in the Collaring state 530 and the calculation in the second calculation state 542 indicates the interval has now completed, the second calculation state 542 emits an event indicating the drilling interval is now complete. The state machine has a definition specifying that on receipt of that event, if the current state is Collaring state 530, it should trigger a transition to Release Tension Ground state 520. The transition is also "guarded" by a conditional statement that checks for a condition to be true. In this instance, the guard is that the Collaring state 530 is still within the Surface Collaring sub-state 536 (calculated in 532). Both the guard being true and the event being emitted are required to transition to the Release Tension Ground state 520.

In the scenario where the surface collaring depth has passed, the interval complete event will still be emitted, but the guard condition (within surface collaring depth 532) would be false. This would cause no state machine transition and the state will remain Collaring state 530.

INDUSTRIAL APPLICABILITY

The arrangements described are applicable to the mining industry.

Although the invention has been described with reference to specific examples, it will be appreciated by those skilled in the art that the invention may be embodied in many other forms. The foregoing describes only some embodiments of the present invention, and modifications and/or changes can be made thereto without departing from the scope and spirit of the invention, the embodiments being illustrative and not restrictive.

In the context of this specification, the word "comprising" and its associated grammatical constructions mean "including principally but not necessarily solely" or "having" or "including", and not "consisting only of". Variations of the word "comprising", such as "comprise" and "comprises" have correspondingly varied meanings.

As used throughout this specification, unless otherwise specified, the use of ordinal adjectives "first", "second", "third", "fourth", etc., to describe common or related objects, indicates that reference is being made to different instances of those common or related objects, and is not intended to imply that the objects so described must be provided or positioned in a given order or sequence, either temporally, spatially, in ranking, or in any other manner.

Reference throughout this specification to "one embodiment," "an embodiment," "some embodiments," or "embodiments" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

While some embodiments described herein include some but not other features included in other embodiments, combinations of features of different embodiments are meant to be within the scope of the invention, and form different embodiments, as would be understood by those skilled in the art. For example, in the following claims, any of the claimed embodiments can be used in any combination.

Furthermore, some of the embodiments are described herein as a method or combination of elements of a method that can be implemented by a processor of a computer system or by other means of carrying out the function. Thus, a processor with the necessary instructions for carrying out such a method or element of a method forms a means for carrying out the method or element of a method. Furthermore, an element described herein of an apparatus embodiment is an example of a means for carrying out the function performed by the element for the purpose of carrying out the invention.

In the description provided herein, numerous specific details are set forth. However, it is understood that embodiments of the invention may be practised without these specific details. In other instances, well-known methods, structures and techniques have not been shown in detail in order not to obscure an understanding of this description.

Note that when a method is described that includes several elements, e.g., several steps, no ordering of such elements, e.g., of such steps is implied, unless specifically stated.

The term "coupled" should not be interpreted as being limitative to direct connections only. The terms "coupled" and "connected," along with their derivatives, may be used. It should be understood that these terms are not intended as synonyms for each other, but may be. Thus, the scope of the expression "a device A coupled to a device B" should not be limited to devices or systems wherein an input or output of device A is directly connected to an output or input of device B. It means that there exists a path between device A and device B which may be a path including other devices or means in between. Furthermore, "coupled to" does not imply direction. Hence, the expression "a device A is coupled to a device B" may be synonymous with the expression "a device B is coupled to a device A". "Coupled" may mean that two or more elements are either in direct physical or electrical contact, or that two or more elements are not in direct contact with each other but yet still co-operate or interact with each other.

We claim:

1. A drill control module for controlling interval-drilling functionality of a drill rig, comprising:

a processor;

a storage medium for storing a computer program having instructions that when executed on the processor perform the method steps of:

drilling a hole by repeatedly:

activating a hammer drilling mode for a predefined interval parameter, said activated hammer drilling mode causing a drill bit of said drill rig to impact a surface using a hammer drilling technique; and activating a pause interval, during which said drill rig retracts said drill bit from said surface at a fixed rate, and air pressure is applied to remove cuttings.

2. The drill control module of claim 1, wherein said predefined interval parameter is one of a drilling interval depth and a drilling interval time.

3. The drill control module of claim 2, wherein said predefined interval parameter is an interval depth in the range of 5 cm to 10 m.

4. The drill control module of claim 1, wherein said hammer drilling mode is implemented using:

a gain scheduling controller driven by an input air pressure value generated by the drill bit operating in said hammer drilling mode, wherein said gain scheduling controller is utilised to generate a feed relief value for adjusting pressure applied to a feed cylinder to control weight on said drill bit.

5. The drill control module according to claim 4, wherein said hammer drilling mode is implemented using:

a set of max controllers, each max controller monitoring a max controller feedback reference signal and decreasing the feed relief value when said monitored max controller feedback reference signal exceeds a predefined first setpoint; and a set of min controllers, each min controller monitoring a min controller feedback reference signal and increasing the feed relief value when said monitored min controller feedback reference signal falls below a predefined second setpoint;

wherein a feed relief signal is based on an output of one of said gain scheduling controller, said max controllers, or said min controller.

6. The drill control module according to claim 5, wherein said hammer drilling mode is associated with a hammer drilling configuration, said hammer drilling configuration defining a set of hammer drilling parameters for use by said gain scheduling controller, said set of max controllers and said set of min controllers.

7. The drill control module according to claim 1, wherein said computer program has instructions that when executed on the processor perform the further method steps of:

implementing a state machine, wherein said state machine includes a find ground state, a release ground tension state, and a collaring state; and rotating the drill bit during said pause interval while in said collaring state.

8. The drill control module of claim 1, wherein the fixed rate is 1 mph.

9. The drill control module of claim 1, wherein, during said pause interval, said drill rig retracts said drill bit to a set depth.

10. A method of controlling interval-drilling functionality of a drill rig, comprising:

drilling a hole by repeatedly:

activating a hammer drilling mode for a predefined interval parameter, said activated hammer drilling mode causing a drill bit of said drill rig to impact a surface using a hammer drilling technique; and activating a pause interval for a predefined pause interval time, during which said drill rig retracts said drill bit from said surface at a fixed rate and air pressure is applied to remove cuttings.

11. The method of controlling interval-drilling functionality of a drill rig according to claim 10, wherein said predefined interval parameter is a drilling interval depth to be drilled by the drill rig during each interval.

12. The method of controlling interval-drilling functionality of a drill rig according to claim 11, wherein said predefined interval parameter is a drilling interval depth in the range of 5 cm to 10 m.

13. The method of controlling interval-drilling functionality of a drill rig according to claim 10, wherein said predefined interval parameter is a drilling interval time.

14. The method of controlling interval-drilling functionality of a drill rig according to claim 10, wherein said hammer drilling mode is implemented using:

a gain scheduling controller driven by an input air pressure value generated by the drill bit operating in said hammer drilling mode, wherein said gain scheduling controller is utilised to generate a feed relief value for adjusting pressure applied to a feed cylinder to control weight on said drill bit.

15. The method of controlling interval-drilling functionality of a drill rig according to claim 14, wherein said hammer drilling mode is implemented using:

a set of max controllers, each max controller monitoring a max controller feedback reference signal and decreasing the feed relief value when said monitored max controller feedback reference signal exceeds a predefined first setpoint; and a set of min controllers, each min controller monitoring a min controller feedback reference signal and increasing the feed relief value when said monitored min controller feedback reference signal falls below a predefined second setpoint;

wherein a feed relief signal is based on an output of one of said gain scheduling controller, said max controllers, or said min controller.

16. The method of controlling interval-drilling functionality of a drill rig according to claim 15, wherein said hammer drilling mode is associated with a hammer drilling configuration, said hammer drilling configuration defining a set of hammer drilling parameters for use by said gain scheduling controller, said set of max controllers and said set of min controllers.

17. The method of controlling interval-drilling functionality of a drill rig according to claim 15, wherein each max controller is a proportional controller that calculates an error between an input signal and a configured third setpoint received by that max controller.

18. The method of controlling interval-drilling functionality of a drill rig according to claim 15, wherein each min controller is a proportional controller that calculates an error between an input signal and a configured fourth setpoint received by that min controller.

19. The method of controlling interval-drilling functionality of a drill rig according to claim 10, comprising the further method steps of:

implementing a state machine, wherein said state machine includes a find ground state, a release ground tension state, and a collaring state; and rotating the drill bit during said pause interval while in said collaring state.

20. The method of controlling interval-drilling functionality of a drill rig according to claim 10, wherein the fixed rate is 1 mph.

21. The method of controlling interval-drilling functionality of a drill rig according to claim 10, wherein, during said pause interval, said drill rig retracts said drill bit to a set depth.

* * * * *